United States Patent [19]

Amprim et al.

[11] 4,211,021

[45] Jul. 8, 1980

[54] ENGINE COMPARTMENT LABEL

[75] Inventors: Lawrence Amprim, Farmington, Mich.; Frederick P. Williams, Kettering, Ohio

[73] Assignee: Monarch Marking Systems, Inc., Dayton, Ohio

[21] Appl. No.: 878,097

[22] Filed: Feb. 15, 1978

[51] Int. Cl.[2] ..... A44C 3/00

[52] U.S. Cl. ..... 40/2 R

[58] Field of Search ..... 40/2 R, 2.2, 594–615; 428/40, 187, 224

[56] References Cited

U.S. PATENT DOCUMENTS

| | | | |
|---|---|---|---|
| 2,341,713 | 2/1944 | Griswold | 117/30 |
| 2,369,549 | 2/1945 | Francescon | 40/2 R |
| 2,561,064 | 7/1951 | Ness | 117/68.5 |
| 2,828,776 | 4/1958 | Meyer | 40/2 R X |
| 2,975,091 | 3/1961 | Tobey | 40/2 R X |
| 3,067,054 | 12/1962 | Reese | 117/3.4 |
| 3,085,572 | 4/1963 | Blackford | 128/156 |
| 3,296,723 | 1/1967 | Gobel | 40/2 R |
| 3,494,056 | 2/1970 | Elzer | 40/2 R |
| 3,549,482 | 12/1970 | Okutani | 161/254 |
| 3,595,739 | 7/1971 | Meyer | 40/2 R X |
| 3,770,559 | 11/1973 | Jacjson | 161/89 |

*Primary Examiner*—Louis G. Mancene
*Assistant Examiner*—Wenceslao J. Contrera
*Attorney, Agent, or Firm*—Jones, Tullar & Cooper

[57] ABSTRACT

This invention relates to a pressure sensitive adhesive label which can be used under severe service conditions such as those found in an automobile engine compartment.

The label comprises a laminate comprising a temperature stable woven or non-woven fabric having an ink receptive coating on a first side and a high performance pressure sensitive adhesive coating on the other side thereof.

5 Claims, 2 Drawing Figures

ENGINE COMPARTMENT LABEL

BACKGROUND OF THE INVENTION

The advent of pollution control devices on automobile engines has generally raised the operation temperature of the engines and thus has raised the demands placed on labels present on the engine or in the engine compartment.

It is presently desired that a label having the following characteristics be available to the automotive industry: resistance to oil, gasoline, water, etc.; printability with non-volatile inks; sufficient flexibility to conform to irregular surfaces, good tensile strength and abrasion resistance, strong adhesion, die cutability; processability through applicators and dispensers; and over all in service resistance to temperatures in the range of 300° F. to 400° F. and possibly higher.

The labels of this invention meet these requirements.

Heretofore, both fabric labels or tapes have been utilized for various purposes. For example, fabric labels have been frequently employed as name tags for conventions or meetings. These labels are most commonly formed from a material known as satin cloth, i.e. cellulose acetate, and having printing on one side with the other side coated with a pressure sensitive adhesive.

Another pressure sensitive adhesive coated fabric label known in the art comprises a non-woven polyolefin fabric having a pressure sensitive adhesive backing.

Non-adhesive printed labels, or tags, such as those which contain fabric descriptions and/or laundering instructions in garments have been sold for some time, which are formed from spunbound non-woven polyester fabric, or woven nylon or polyester, which have been coated for ink receptiveness. The fabric, ink receptive coating and the printing ink employed in making these tags all fall within the scope of the fabric, ink receptive coatings and printing inks which can be used to form the labels of the present invention.

DESCRIPTION OF THE INVENTION

There have now been discovered labels which have high temperature performance characteristics and which meet the above described automotive engine compartment performance standards.

Figure 1:
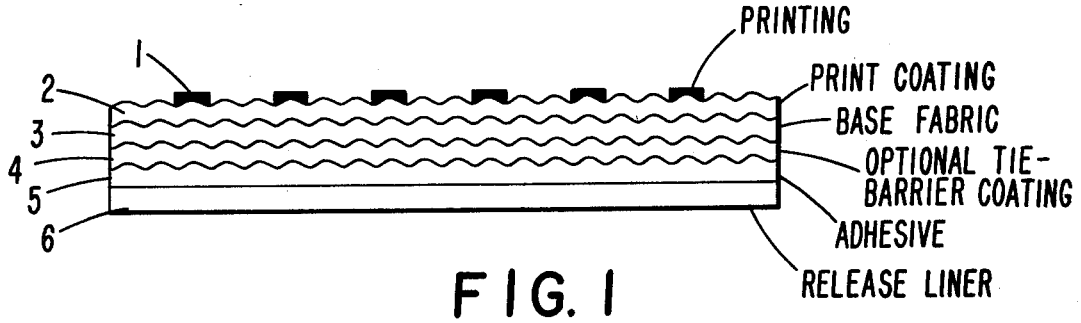
FIG. 1 is a schematic representation of the label of the invention.
Figure 2:
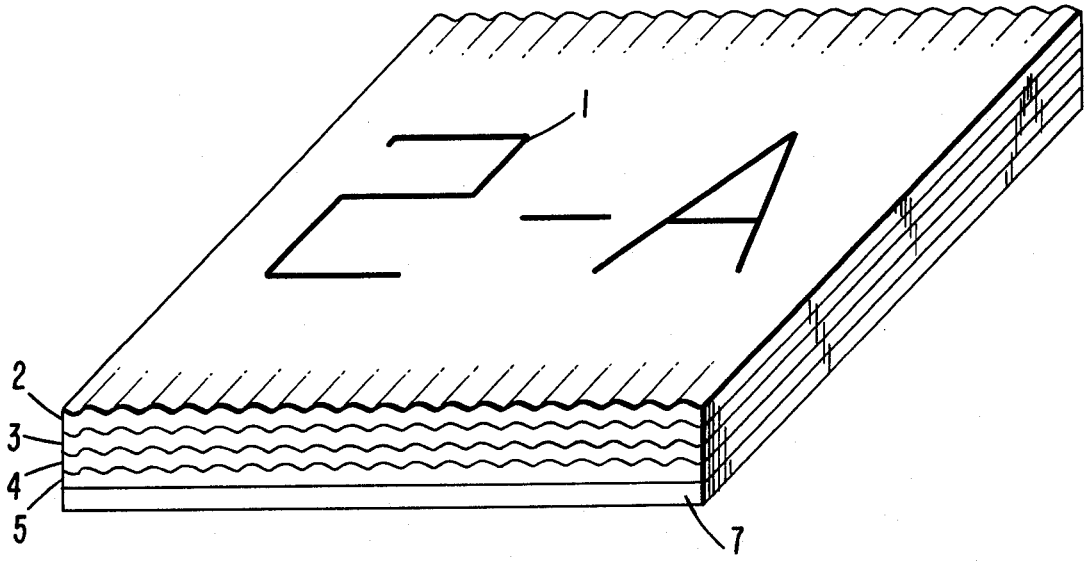
FIG. 2 is a schematic representation of the label of the invention adhered to a substrate.

With reference to FIGS. 1 and 2 the labels of the invention comprise a woven or non-woven fabric 3 which has less than about 10% length or width dimensional change after 20 minutes at 300° F., having an ink receptive coating 2 on at least one side thereof, with a pressure sensitive adhesive 5 on the other side.

The woven or non-woven fabric comprises a high melting point synthetic fiber, such as a polyester, for examples, poly(ethylene terephthalate) and poly(1,4-cyclohexylene dimethylene terepthalate) or a nylon, for example, nylon 6,6 or nylon 6, nylon 6, 10, and the like, alone or in blends and/or blended with about 65% or less of cotton. The synthetic fiber should have a melting point about about 230° C. and preferably above about 250° C.

While the thickness of the fabric is not unduly critical, the fabric generally should have a thickness between about 0.001 inch and about 0.02 inch, and preferably between about 0.003 inch and about 0.01 inch.

The fabric (e.g. 3¼ ounces per square yard, 50% polyester, 50% cotton) is coated on at least one side and preferably on both sides with an ink receptive coating 2 and 4 (e.g. 0.5 to 1 mil.) which is relatively heat, water, and oil resistant and which strongly adheres to the fabric; for example, a urethane rubber modified thermoplastic organic polymer in an amount of approximately 0.75 ounces per square yard, per side, to provide on the one hand an ink receptive surface and on the other hand to provide improved anchorage of the adhesive and a barrier to adhesive penetration from the unprinted side. While it is essential that the viewed side of the fabric label have the ink receptive coating, it is desirable to coat the reverse adhesive facing of the fabric as well, to provide the aforementioned adhesive penetration barrier.

The thermoplastic polymer coating may be applied to the fabric by any suitable conventional coating means such as a roller or doctor blade coating method.

The adhesive side of the fabric, preferably coated as above, is coated in a conventional manner with a pressure sensitive thermosetting acrylic adhesive 5 which has sufficient adhesion stability to firmly bond the label to a substrate in an automobile engine compartment and remain bonded during normal service. The acrylic adhesive can be virtually any acrylic thermosetting pressure sensitive adhesive which retains significant bond strength at temperatures between about 300° F. and 400° F.

On particularly useful example of a pressure sensitive adhesive is a 55% solution of a thermosetting acrylate solution polymer (containing substantially no methacrylate units) containing between about 0.5 to about 10% of a melamine formaldehyde resin in 75% ethyl acetate and 25% toluene (by volume), having a Brookfield viscosity of between 12,000–18,000 cps. at 29° C. During the processing and laminating the volatile solvent vaporizes to provide a relatively nonvolatile, tacky, adhesive film. Representative physical data of a mil. dry film of this adhesive applied to a Mylar film (cured at 250° F. for 2 minutes) are as follows:

| | |
|---|---|
| Quick stick (rolling ball-incline plane) $\frac{\text{Inches of Fall}}{\text{Inches of Travel}} = 1.2$ | |
| 180° Peel Adhesion | (Pressure Sensitive Tape Council Test Method PSTC-1) Initial = 56 oz. Overnight = 76 oz. |
| 20° Hold | (½ × ½ inch adhesive strip, 20° chrome plated bar, 200 gm. wt.) = 19 hours |
| 50° C. Creep | 1 × ½ inch adhesive strip attached at the vertical to stainless steel plate, 250 gm. wt.) = 24+ hours |
| Williams Plastometer (100° C.) = 1.73. | |

In most applications, the adhesive layer, after drying, will have a thickness between about 0.3 mil. and about 3 mils., although these limits are by no means critical.

The labels of this invention are printable with solvent resistant inks 1 such as those known in the art for printing the fabric garment care instruction tabs known in the art as discussed above. One type of ink useful is an nonvolatile ink applicable by a felt roll, which dries by penetration. One particular useful ink imprinting formulation comprises a relatively nonvolatile, aliphatic diester oil based vehicle containing a thoroughly dispersed sub-micron heat, oil, water and UV fade resistant pigment. The ink may also contain dyes, such as pararosaniline dyes as intensifiers and bodying agents such as castor oil derivatives. The exact chemical composition of the ink is not critical so long as when it is applied to the above described coating it forms a legible, relatively solvent resistant, water resistant imprint having good ultraviolet fade resistant qualities. It should be noted that the ink and the ink receptive coating are selected so that the nonvolatile imprinting ink penetrates the coating to permit "drying" (rub resistance) within a desired time without excessive spreading over the surface to cause excessive width or "filled in" characters.

In order that the label can be handled and stored more readily, for example, individually, in a rolled tape form or a flexible sheet form, the substrate adhering surface of the label can be temporarily covered with a release sheet or liner 6, of the type conventionally known in the art, for example, a silicone treated paper. In a preferred embodiment, the release paper is a semi-bleached release paper coated on its adhesive contacting side with a silicone release agent. As is conventional, the release agent is selected with a tight enough release level to allow the label to be conveyed to the object being labeled without premature separation of the release sheet, but with a release level low enough so that the release sheet can be readily, intentionally removed to expose the adhesive layer for bonding when desired. The release level should be lower than the level of the adhesion of the adhesive for the cloth label to prevent delamination of the label upon removal of the release sheet.

One specific example of the label of the invention comprises a woven 3¼ ounces per square yard, 50% polyethylene terephthalate/50% cotton fabric coated on both sides with one mil. of the above described urethane rubber modified polymer coating one side of which was further coated with a 1 mil. adhesive layer formed from the described acrylate adhesive containing 1% melamine-formaldehyde resin. The other side is printed with a heat, oil and water resistant ink composed of a nonvolatile aliphatic diester vehicle containing pigment and nigrosine dye, together with a castor oil derivative bodying agent; a silicone coated release paper protecting the adhesive during handling.

What is claimed is:

1. A label comprising (a) a woven or non-woven fabric core where the fabric comprises a synthetic organic polymer fiber having a melting point of at least about 230° C., and which fabric core has less than about 10% dimensional change after 20 minutes at 300° F., (b) said fabric core being coated on at least one side thereof with an adherent film of an ink receptive coating penetrable by a non-volatile printing ink which dries by penetration, (c) said fabric core being coated on the other side thereof with an adherent layer of an initially tacky pressure sensitive thermosetting acrylic adhesive which maintains significant bond strength at temperatures between about 300° F. and 400° F.

2. The label of claim 1 where the fabric core is coated on both sides with said ink receptive coating and where the pressure sensitive adhesive is coated upon one side of said coated fabric core.

3. An internal combustion engine having adhered thereto the label of claim 1.

4. The label of claim 1 adhered to a surface on the interior of an internal combustion engine compartment.

5. A method of forming a label which comprises:

(a) coating a fabric core formed from a fabric which comprises a synthetic organic polymer fiber having a melting point of at least 230° C., and which has less than about 10% dimensional change after 20 minutes at 300° F. with (b) an non-volatile ink penetrable, ink receptive polymeric coating to at least the print receiving side of said fabric, (c) applying an adherent layer of an initially tacky pressure sensitive thermosetting acrylate adhesive which maintains significant bond strength at temperatures between about 300° F. and 400° F. to the opposite side of the resultant coated fabric core, (d) printing upon the coated print receiving side of said fabric core with a non-volatile ink which penetrates into the polymeric coating to form a rub-resistant information containing imprint.

* * * * *